United States Patent [19]

Weinar

[11] Patent Number: 4,467,578

[45] Date of Patent: Aug. 28, 1984

[54] CONCEALABLE WALLBOARD FASTENER AND WALLS AND PARTITIONS ASSEMBLED WITH THE AID THEREOF

[76] Inventor: Roger N. Weinar, 19 Parkside Ave., Hamburg, N.Y. 14075

[21] Appl. No.: 314,771

[22] Filed: Oct. 26, 1981

Related U.S. Application Data

[63] Continuation-in-part of Ser. No. 171,331, Jul. 23, 1980, Pat. No. 4,296,580, and a continuation-in-part of Ser. No. 184,961, Sep. 8, 1980, Pat. No. 4,333,286, and a continuation-in-part of Ser. No. 289,709, Aug. 3, 1981.

[51] Int. Cl.[3] ..... E04B 1/00

[52] U.S. Cl. ..... 52/281; 52/489; 52/509; 52/714; 52/741

[58] Field of Search ..... 52/489, 714, 715, 509, 52/281, 481, 480, 483, DIG. 6, 741

[56] References Cited

U.S. PATENT DOCUMENTS 2,317,428 4/1943 Anderson ..... 52/714 X
4,333,286 6/1982 Weinar ..... 52/489 X

FOREIGN PATENT DOCUMENTS 2112843 10/1971 Fed. Rep. of Germany ..... 52/509

*Primary Examiner*—Carl D. Friedman
*Attorney, Agent, or Firm*—Raymond F. Kramer

[57] ABSTRACT

Walls and partitions are constructed by securing wallboard panels to a substructure, such as one of conventional metal or other framing members, by a series of concealed fastening clips, some of which are affixed to the framing members by nail or screw fasteners and others of which, while not held to the framing members, help hold adjacent wallboard panels together and in alignment with each other at the panel sides, which are usually in abutting relationship. The fastening clips are made from sheet or strip material and include a base portion having a substructure contacting surface and a panel contacting surface spaced apart by intermediate strengthening walls, a web portion at about a right angle to the base portion and tab means extending from the web portion and suitable for entering the side of the panel to which the clip is to be appended. Preferably, the bases of such clips are substantially rectangular or are shaped like a T and include longitudinal rails or an equivalent part, and a plate portion, with intermediate strengthening walls. In walls or partitions assembled with the aid of such clips, which walls or partitions are disassemblable without harming the wallboard panels, series of such clips are applied alternately to abutting panel sides, with the clips on the wallboard on one side being held to the substructure and the panel side, and the clips on the wallboard on the other side being held to the panel side but not to the substructure.

In a preferred aspect of the invention the basic clip structure is modified to include "latch" or "catch" means on a plurality of clips to be held to one side of a panel board and to the substructure and the other of such catch or latch means on a corresponding plurality of complementary clips to be held to the abutting side of another panel board, with such sets of clips, or mounting means being capable of being fitted together and easily separated, so as to promote ease of removal of individual wallboard panels without the need to remove adjacent panels.

18 Claims, 16 Drawing Figures

Fig. 8
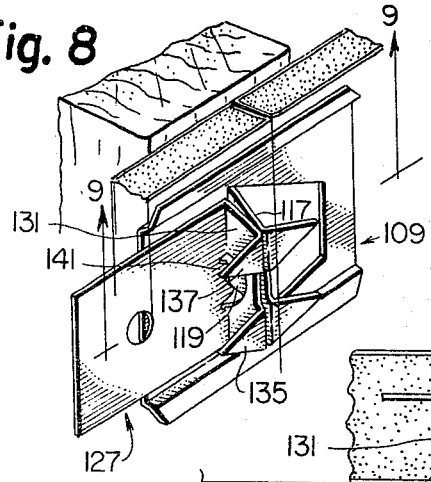
Fig. 16
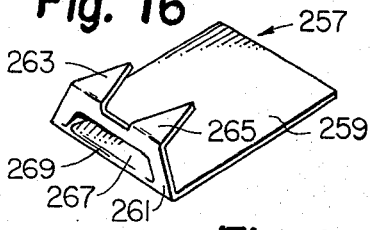
Fig. 9
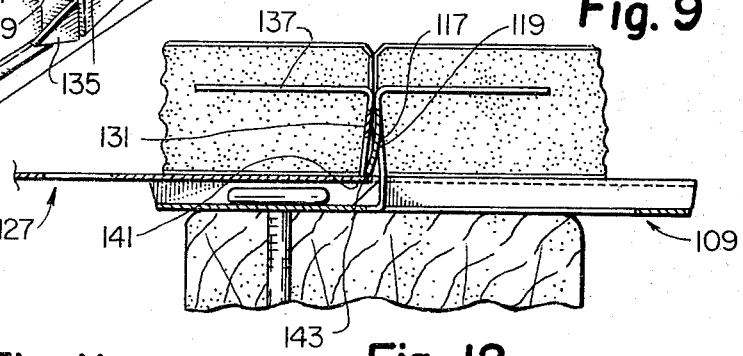
Fig. 11
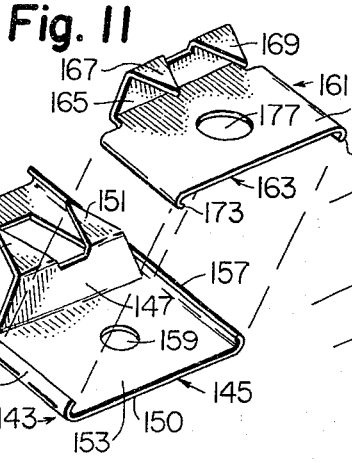
Fig. 12
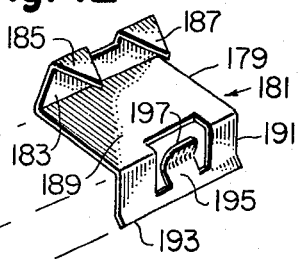
Fig. 10
Fig. 15
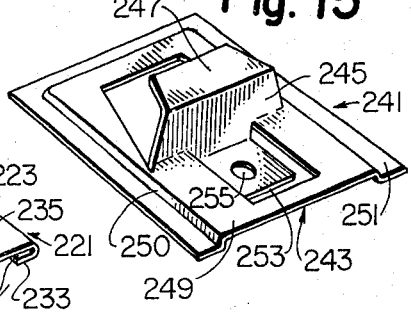
Fig. 14
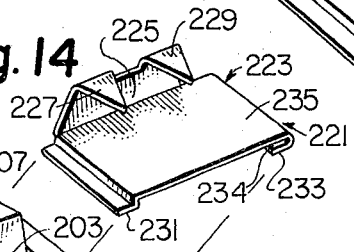
Fig. 13
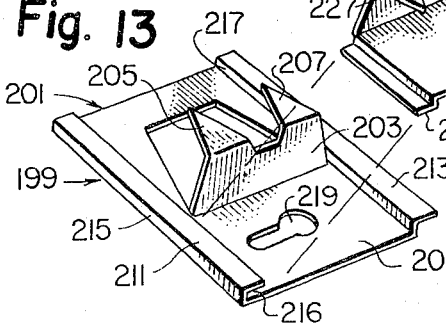

CONCEALABLE WALLBOARD FASTENER AND WALLS AND PARTITIONS ASSEMBLED WITH THE AID THEREOF

This application is a continuation-in-part of my copending application Ser. Nos. 171,331, 184,961 and 289,709, filed July 23, 1980, Sept. 8, 1980, and Aug. 3, 1981, respectively. Ser. Nos. 171,331 and 184,961 have been issued as U.S. Pat. Nos. 4,296,580 and 4,333,286, on Oct. 27, 1981 and June 8, 1982, respectively.

The present invention relates to concealable fastening clips useful for holding wallboard panels to substructures, such as framing members, and in alignment with one another. More particularly, it relates to such fastener clips which include spaced apart base surfaces, connected by strengthening intermediate walls, which surfaces are adapted for contacting the substructure and the back major surfaces of wallboard panels, respectively, thereby holding the panels off the substructure, which facilitates assembly of the panels during construction of a wall or a partition from them. Preferably, the fastening clips of this invention incorporate impaling means for holding them to a side of a wallboard panel and are generally rectangular in shape, often with longitudinal outside rails on the base serving to provide the mentioned spacing function, and in more preferred embodiments, with catch (and sometimes latch) means for engaging with complementary clips, of different designs, to make a wall or partition assembled with the aid of such fasteners and clips very easily disassemblable. Also within the invention are walls and partitions assembled with the aid of the described fasteners, or with the aid of fasteners and complementary clips, and methods for assembly and disassembly of such walls.

The fasteners of this invention may be employed in the assembly of common wallboard panels, such as paper or polymer wrapped gypsum wallboard, onto common wall substructures, such as framing members of wood or metal, in the forms of studs and furring runners. The clips hold the panels together and to the framing members and allow them to be removed comparatively easily, when desired, and in some cases allow the removals of individual wallboards without the need to remove adjacent wallboards. The wallboards used may be produced by various methods and may be of any suitable compositions but they are usually comparatively thin rectangular panels with gypsum cores and a paper or polymer, e.g., vinyl, covering. These commonly named "drywall" panels are available with a decorated factory applied surface cover, such as textured vinyl, which eliminates the need to paint or otherwise treat the wall after erection thereof. Such polymer coated panels, which are being successfully used in many commercial and residential installations, are very preferably assembled utilizing concealed means for holding them to the framing members and other substructures, because of the unsightly result of employing nails, screws, staples or other visible fasteners, and the difficulties of covering such fasteners and any marks left from installation. Also, covering such marks with tapes or other means has generally proved to be unsatisfactory, at least for pre-coated panels. Accordingly, it is to such concealable fasteners, walls made with them and methods for their assembly and disassembly that the present invention is directed.

Among the most successful concealable wallboard fasteners are those described in my U.S. Pat. Nos. 4,117,644 and 4,221,095, which are widely used, being of excellent reputation and well known to mechanics in the construction industry. However, while such fasteners are economical and labor reducing, and satisfactorily hold the assembled panels in position, ordinary assembly and disassembly, if desired, require sequential mounting and dismounting, respectively. Although some versions of the presently claimed invention also require such sequential operations, an improved version of such basic invention, also described in this patent application, and the novel construction method to be described herein permit any one or more of the assembled wallboard panels, normally after sequential assembly, to be dismounted from the framing structure by slight movement of a panel vertically, after which holding means on complementary clips may be removed and the released wallboard may be removed from the wall. Thus, the invention provides easy access to mechanical and electrical utilities, plumbing, junction boxes, telephone connector panels, air conditioning ducts, wiring and cleanouts, which are often located within the wall cavities behind the wallboards. The invention also permits individual replacements of damaged panels and allows ready access to the framing members for alterations and relocations.

The closest prior art known to me are my patents, described above, and my Pat. Nos. 4,296,580 and 4,333,286. Also of interest is a clip manufactured and sold by Rollform Inc. since about July, 1980, in which the reinforcing and spacing function of the depressed area and connecting walls of my fastener clip, illustrated in U.S. Pat. Nos. 4,117,644, 4,221,095 and 4,296,580, are effected by a plurality of indentations in the clip base. In addition to the art cited against the mentioned patents and applications, it is considered that the following references, found in a search conducted in the classified patents in the U.S. Patent and Trademark Office, are also of relevance. However, none of the applicable art describes the invention of this application, none is closer to it than the patents and applications mentioned and none describes or suggests the various more specific embodiments of the invention described herein.

U.S. Pat. No. 3,852,927 describes an apparatus for mounting wallboard in which mounting clips are employed in a latching arrangement to secure wallboard panels to "C" or channel shaped framing members. This patent discloses the use of a channel-shaped catch clip which engages a channel shaped framing member. In actual practice the construction of the patent has been found to be impractical because most commercial channel studs do not have the identical flange dimensions required and therefore special studs would have to be provided for this system. The apparatus of this patent also often requires a hole in an exposed face of a panel to facilitate panel removal, which will be highly objectionable in most installations.

In U.S. Pat. No. 3,922,764 there is described a latch type of clip with pointed barbs for fastening it to a panel. While this system does permit individual panel removal and has found some acceptance in the marketplace, the clips are only useful on I-shaped framing members, which are uncommon. The panels of this patent are held in place by snap fitting and therefore such holding may not be as positive as is sometimes desired because it is necessary to balance the force that is desirable to secure the panel with the force required for panel removal. In actual practice it has been found that this balance is sometimes very delicate and must accommodate the widely varying properties of common wallboards, which come in many thicknesses and densities. Warped or deformed wallboards, such as are frequently encountered on building sites, also require a greater holding force than may be obtainable by use of the fasteners of the design shown in this patent. A similar latch clip, with a more positive locking tab is used by others in the industry on an "I" type of framing member but such systems do not permit individual panel removals and have found limited acceptance.

In accordance with the present invention a fastener, useful for installing wallboard or similar panels on a substructure to form a wall or partition wherein means for holding such panels to the substructure are substantially concealed, has been made from a sheet or strip material and comprises a substantially coplanar and directly continuous spacing base portion which includes, spaced apart, a substructure contacting surface and a panel contacting surface, spaced apart by intermediate strengthening walls, which spacing base portions space a major back panel surface from said substructure when such fastener is installed, a web portion extending at about a right angle from said base portion and tab means extending from the web portion and suitable for entering the side of a panel to which the clip is appended, with the panel contacting surface of the base portion contacting a major back surface of a panel and with the web contacting a side thereof. Preferably such fastener is one which includes means for readily removably engaging with a complementary fastener clip which is attachable to another wallboard panel at a side thereof, so as to hold the wallboard panels together and in alignment at sides thereof and to allow easily effected dismantling of the wall by easy separation of the fasteners, when desired, while they remain fastened to the respective wallboard panels. In conjunction, the fastener and complementary fastener, or fastener clip and complementary fastener clip, may be referred to as "mounting means". Most preferably, such a fastener is one which includes a catch portion with which a latch portion of a complementary clip engages. Also within the invention are walls and partitions made with the aid of such fasteners, and methods of assembling and disassembling such walls and partitions.

The invention will be readily understood by reference to the description herein, taken in conjunction with the drawing, in which:

FIG. 8 is perspective view of an interfitting assembly of the clips of FIG'S. 6 and 7 (such combination of catch clip and latch clip being referred to as "mounting means"), with such assembly being shown in the manner of FIG. 3, but on wallboards held to a wooden stud substructure member;

FIG. 9 is an enlarged sectional view along plane 9—9 of the installed complementary clips of FIG. 8;

FIG. 10 is a perspective view of a modified fastener having curled rail portions at the longitudinal sides thereof;

FIG. 11 is a complementary clip for snap or slide fastening with a clip like that of FIG. 10;

FIG. 12 is a perspective view of another complementary clip for engagement with the clip of FIG. 10;

FIG. 13 is a perspective view of another modification of the fastener clip of this invention;

FIG. 14 is a perspective view of a complementary clip intended for use with the clip of FIG. 13;

FIG. 15 is a perspective view of another modified fastener clip of this invention, for installation in a manner like that shown in FIG. 3; and FIG. 16 is a perspective view of another embodiment of the latch clip—corner clip of this invention, intended for installation in a manner like that illustrated in FIGS. 8 and 9.

Figure 1:
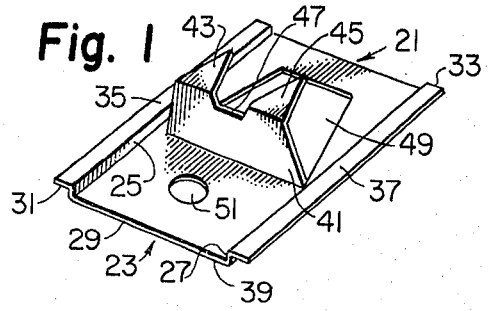
FIG. 1 is a perspective view of a fastener clip of this invention which is of generally rectangular shape, incorporating impaling tabs and side rails, and which is intended for use with other such fasteners in concealably assembling wallboards, such as pre-finished wall panels.
Figure 3:
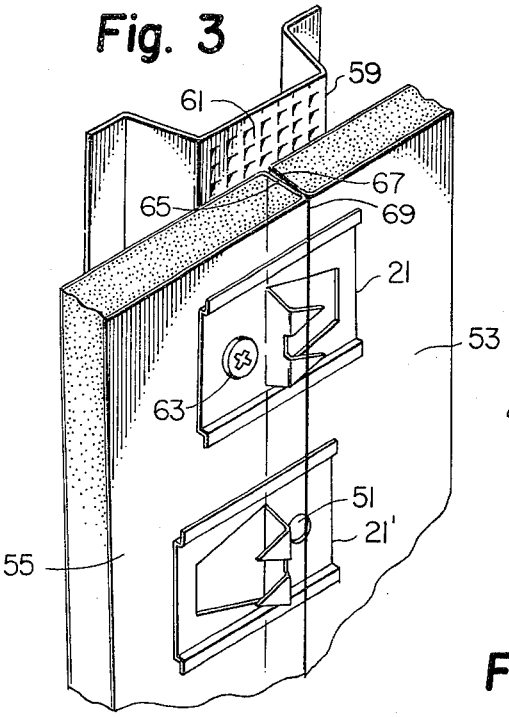
FIG. 3 is a perspective view of a part of a pair of side-abutting wallboards assembled onto a metal stud substructure with the aid of fastener clips of this invention like those shown in FIG'S. 1 and 2, with the clips being illustrated, for clarity, as if the wallboards were transparent in front of them, although the clips are installed behind the wallboards, away from the viewer.

Referring to FIG. 1, wallboard fastener clip 21, made of a comparatively thin sheet or strip material, such as metal, e.g., hardenable steel, includes what will be termed a substantially coplanar and directly continuous spacing base portion 23, having, spaced apart by intermediate strengthening walls 25 and 27, a plate portion 29 and longitudinal rails 31 and 33. As illustrated, the surfaces 35 and 37 of the rails contact a back major surface of a wallboard panel when the fastener is installed, as illustrated in FIG. 3, and surface 39 of plate 29 contacts the substructure or framing member (stud or furring strip) on which the wallboard panel is installed. Fastener clip 21 also includes a web portion 41, which extends at about a right angle from plate 29 of base portion 23 of the fastener, and has pointed tab means 43 and 45 extending from it, also at about a right angle. The tab means are suitable for entering the side of a wallboard panel to which the clip is to be appended. When so installed, as illustrated in FIG. 3, a base portion of the clip (the rails, as shown in FIG. 1 and FIG. 3) will contact major back surfaces of adjacent panels and the web will contact the sides thereof. In some instances, as when the panels are intentionally installed with an opening between them, which is usually filled with another material, such base may contact major back surfaces of adjacent panels and the web may contact only a side of one panel. In such a case a fastener clip somewhat like that illustrated in FIG. 9 of my application Ser. No. 184,961 may be used. The pointed tabs 43 and 45, for impalement into a side of a panel to which the clip is to be appended, are shown in the forms of isosceles trangles, with the bases at the web, but other shapes of such points may also be employed. Also, while web 41 has material removed from it at 47, which helps in bending the web to form the tabs, assists the impaling action of tabs 43 and 45 when they are being installed, and helps to maintain them in desired position with respect to the wallboard panel side, it is within the invention to omit removal of such material. It may be noted that opening 49 in plate 29 is substantially trapezoidal in shape and corresponds substantially to the material removed from it to make web 41 and tabs 43 and 45. Openings of other shapes may also be present in these fasteners and correspondingly, the shapes of the webs may be changed accordingly. Fastener 21, as illustrated, includes an oversized circular mounting opening 51 through which a nail, ridged nail, screw, drive screw or other type of holding means may be passed so as to hold the fastener and the wallboard panel to which it is appended in place with respect to the substructure. The oversized nature of the opening allows a measure of adjustment of position of the fastener clip with respect to the holding means, which is considered to be highly desirable.

Figure 2:
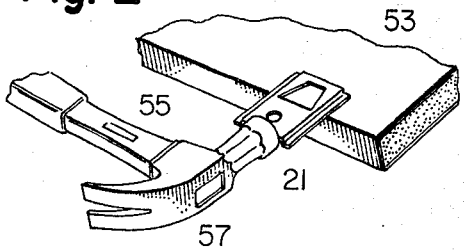
FIG. 2 is a perspective illustration, on a reduced scale, illustrating installation of a fastener clip like that of FIG. 1 onto a side of a prefinished wallboard panel.

In FIG. 2 fastener clip 21 is shown being installed on wallboard 53 at side 55 thereof with the aid of hammer 57. As is illustrated, the hammer head strikes against an end of the fastener and thereby drives pointed tabs 43 and 45 (see FIG. 1) thereof into the wallboard panel. The presence of rails 35 and 37 and strengthening intermediate walls 25 and 27 connecting such rails to plate 29 gives the fastener clip added strength and prevents it from bending or crumpling when struck by the hammer during the impaling operation. If desired, after initial insertion of the impaling points into the wallboard panel side the bases of such points may also be struck by the hammer or force may be exerted on them by an installing tool to drive them further into the wallboard. Alternatively, such a tool may be used instead of the hammer.

FIG. 3 illustrates how a pair of wallboard panels is assembled on a substructure by means of the present fastener clips. Metal vertical stud 59, with fastener starting indentations 61 therein, has wallboard panels 53 and 55 held in place with respect to it by fastener clips 21 and 21', which fasteners hold the wallboards so that their visible surfaces are in alignment too. As illustrated, the fastener clips are drawn with solid lines for clarity of presentation but it should be realized that they are located behind the wallboard panels, adjacent to the back surfaces of such panels and the front surface of framing stud 59. Drive screw 63 holds fastener clip 21 and impaled wallboard panel 53 to stud 59 and similar clips, also impaling panel 53 and screwed to stud 59, are located alternately with clips like that numbered 21' down the vertical length of the wallboard panel and the stud. Fastener clip 21' is identical with fastener 21 but it will be noted that no holding means affixes it in position with respect to stud 59 (opening 51 is visible). Clips 21' are impaled into a side of panel 51 in alternating fashion, as previously mentioned, and align panel 55 with panel 53 so that the visible front surfaces of such panels are continuous and parallel. Panel 55 is held in position against vertical movement by screws fastened to stud 59 or to another suitable substructure member at upper and lower portions thereof where the presences of such screws may be concealed by suitable covers or moldings.

It will be apparent from FIG. 3 that the assembly of the wall illustrated is from right to left. In other words, fastener clips 21 are impaled into the sides of wallboard panel 53 in the desired positions and then screws 63 are employed to fasten clips 21 to substructure 59. Next, panel 55, with fasteners 21' impaled in an abutting side thereof at alternating locations between fasteners 21 (when assembled) is installed, with fasteners 21' passing between stud 59 and panel 53. Thus, panel 55 is held against forward movement, into the room or away from the framing substructure. Subsequently, other fasteners on an opposing side of panel 55 are screwed to the appropriate substructure member and the assembly procedure is continued. The tops and bottoms of the various panels may also then be fastened to the substructure and the screws or other holding means employed may be suitably covered. To disassemble the wall, the reverse procedure is followed, normally starting at a corner or some other such suitable location where covered screws had been employed to fasten an end of a panel to the framing members.

It will be noted that although the wallboard panels are substantially rectangular in shape and the sides and ends thereof are substantially at right angles to the major faces, the sides, as illustrated at 65 and 67 are not always exactly at right angles, sometimes, as illustrated, being intentionally angled slightly so as to promote the making of better contact near front edges thereof, so that minimal openings will be apparent where the panels abut, as at joinder line 69. As will be seen later in this description, the presence of such opening is useful in providing room for catch and latch parts of preferred fasteners employed in assembling readily disassemblable walls from such panels.

Figure 4:
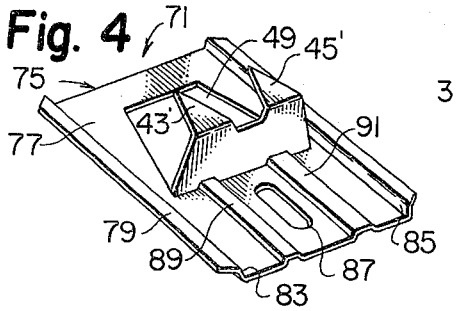
FIG. 4 is a perspective illustration of a modified fastener clip of this invention, including a longitudinal slot and longitudinal reinforcing ribs, which fastener clip is intended for assembly on wallboards in a maner like that shown in FIG. 3.
Figure 5:
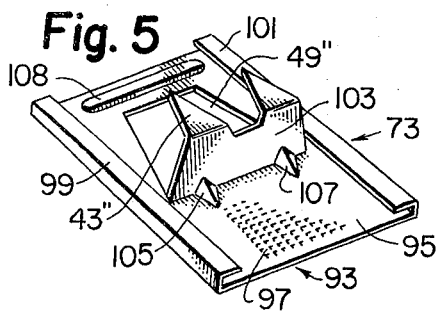
FIG. 5 is an illustration of another embodiment of the fastener clip of this invention, intended for assembly on wallboards in a manner like that shown in FIG. 3.

The fastener clip 71, illustrated in FIG. 4, and fastener 73 of FIG. 5 are both modifications of fastener 21 of FIG. 1. In clip 71 base 75 includes a plate portion 77 and longitudinal rails 79 and 81. Rails 79 and 81 are at an oblique angle to intermediate strengthening walls 83 and 85. It has been found that such rails tend to slide more readily with respect to a panel back surface during installation, and thereby decrease any snagging of the back surface of the panel by the fastener. Plate 77 includes trapezoidal opening 49', an elongated longitudinal slot 87 (for adjustable positioning of the fastener) and reinforcing ribs 89 and 91, which help to strengthen the clip, which is especially important due to the presence of slot 87. Also, ribs 89 and 91 further rigidify the fastener to prevent bending or crumpling thereof when it is struck, as during the impalement operation, when tabs 43' and 45' are driven into a panel side.

Fastener 73 of FIG. 5 also resembles that of FIG. 1 but base 93 includes a plate portion 95 having indentations 97 over at least a portion of the surface thereof, which indentations are suitable for helping to start a drive screw or nail to be driven through the fastener to hold it to a substructure. Thus, there is no need for an oversize opening, which prevents any corresponding weakening of the fastener. Rails 99 and 101 are longitudinally situated and extend inwardly, rather than outwardly, as do those of the fastener of FIG. 1. Between the plate 95 and web 103 are strengthening reverse indentations or protrusions 105 and 107, where the web and plate meet, which indentations extend into what might be considered a quadrant near the panel into which the fastener is impaled and away from the pointed tabs of the fastener. It will be apparent that strengthening reverse indentations 105 and 107 help to rigidify the web and prevent it from collapsing or moving in the direction of the plate when a fastener is struck to impale points 43" and 45" into the panel side. Transverse strengthening rib 108 is located near trapezoidal opening 49" and prevents any twisting of the fastener about a longitudinal or diagonal axis, as might occur due to the presence of the opening 49".

Figure 6:
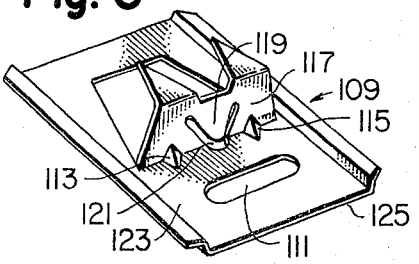
FIG. 6 is a perspective view of a catch clip of this invention.

In FIG. 6 there is shown a "catch"-type fastening clip of this invention, which may be considered to be a modification of the clips of FIGS. 1–5 but which also includes a special disassembly feature that requires the clips to be assembled differently with respect to each other when they are installed on adjacent wallboards. Basically, the fastener 109 of FIG. 6 is like fastener 71 of FIG. 4 with respect to the base, plate, rails and strengthening walls portions thereof. However, there are some differences and one of these is an especially important difference because it affects the mechanism by which such a catch clip is held to a latch clip for the mounting of the wallboard panels, and such mechanism is important in facilitating ready removals of individual wallboards from assembled walls, when that is desired. Although the rails, strengthening walls, trapezoidal opening, parts of the base and plate portions and the pointed tabs of FIG. 6 are identical with those of FIG. 4, it will be seen that in FIG. 6 the longitudinal slot opening 111 is transverse, rather than longitudinal, and there are no strengthening ribs. Also, strengthening reverse indentations 113 and 115 are present, performing the functions described for similar strengthening means 105 and 107 of FIG. 5. The most significant change in the fastener of FIG. 6 is in the incorporation of catch means in web 117 thereof. Similar catch means may be formed into the webs of other types of fasteners, such as those in FIG's. 1, 4 and 5. As will be readily seen, during the manufacture of fastener 109 the portion 119 of web 117 is deformed, usually after an opening 121 is created between it and the adjacent surface 123 of base 125. Such combination of projection 119 and opening 121, in conjunction with surface 123 of base 125, constitutes a "catch", suitable for insertion of a "latch" part therein to maintain the latch clip and the wallboard and the wallboard to which it is appended held by the described catch clip, which in turn is fastened to a substructure, to such substructure and in alignment with the adjacent wallboard panel. The slot 111, which is vertical in normal installations of the panels, allows vertical movement of a panel intended for removal, facilitating release of the panel from the substructure.

Figure 7:
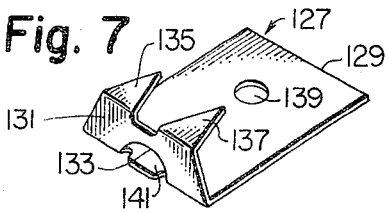
FIG. 7 is a perspective view of a latch clip, capable of being employed in conjunction with a catch clip like that shown in FIG. 6 and also capable of use as a corner clip.

Although various types of latch clips may be made, perhaps the simplest construction of these is illustrated in FIG. 7 herein, which fastener is also suitable for use as an inside corner clip for installing wallboard. Clip 127 includes a base or plate portion 129, a web 131, having an arced opening 133 centrally located therein, a pair of pointed impaling tabs 135 and 137, an oversized hole 139 for passage of holding means therethrough and a latch or latching tab 141, which includes some material taken from the web portion of the sheet or strip base material and which extends from the base, past the web, so as to be capable of fitting into the catch and holding the catch and latch fasteners and their appended wallboard panels together and in alignment until panel removal is desired. In one preferred variation of this clip two separate webs may be present, without the connection between them and they may be farther apart so that the metal of the webs will not contact the portion 119 of clip 109 during any vertical movements prior to release of the appended wallboard and will not promote opening of the wallboard joint due to the presences of double thicknesses of metal clip parts being interposed.

In FIGS. 8 and 9 there are shown illustrations of the interfitting or complementing assembly of catch and latch clips like those of FIG'S. 6 and 7, respectively. In FIG. 8 catch clip 109 is shown in position such as it would be in if it were impaled on a wallboard panel, not shown, and held to a substructure framing member, not shown, by a holding means, not shown, passing through an oversize opening or other suitable opening, e.g., a "vertical" slot, not shown. Thus, catch clip 109 is held to the substructure and to a wallboard panel side. Latch clip 127 is shown in its latching position with respect to catch clip 109 and in the position it would be in when impaled into the side of its abutting wallboard panel. Latch clip 127 is not positively held to the substructure but is held to catch clip 109 and holds its wallboard panel, not shown, in position by means of the engagement of its latching portion 141 in the catch created by the coaction of projection 119, opening 121 and plate surface 123 (FIG. 6) of catch clip 109. In FIG. 9 parts of such elements are shown in cross-section and their function may be clearer from such view. In the cross-sectional view it is seen that catch clip web 117 has projection 119 thereof extending so that the bottom 143 thereof projects past web 117 and holds latch portion 141 in place. It is helpful to the operation of the invention that although sides of wallboard panels are at about right angles to the faces thereof there is a slight taper, for example, from about 80° to 89°, e.g., 84°, from the major front surface of the wallboard panel to near the back thereof and this provides room for extensions of the catch clip projection and the latch clip latching means. The fastener clips may very desirably be shaped to conform to the wallboard panel sides by being tapered at about the angle of such sides, e.g., 84°, is shown in FIGS. 6–9.

In FIGS. 10 and 13 there are shown modifications of the catch fastener of FIGS. 6 and 8, in which fastener clip 143 includes a base portion 145, a web 147 and pointed tabs 149 and 151. Base 145 is comprised of a plate portion 153 and curved longitudinal external rails 155 and 157. Oversized circular opening 159 is present in the plate to provide clearance for holding means, such as a drive screw, for holding the fastener clip to a substructure member. A complementary clip for snap fastening into place with respect to fastener 143 is shown in FIG. 11. Clip 161 includes a base portion 163, web 165 and pointed tabs 167 and 169. Base 163 includes a plate section 171 and longitudinally extending curved rails 173 and 175. Plate 171 also includes an oversized circular opening 177. Normally the fasteners of this invention are made of hardened steel which has resilience or spring-like properties and therefore the rails 173 and 175 of clip 161 are adapted for snap fastening between rails 155 and 157 of "catch" clip 143. When the clips are snapped together and into place, oversized opening 177 provides a clearance for any holding means which may be employed to attach fastener 143 to a substructure through opening 159 therein.

Instead of utilizing complementary clip 161 with fastener 143 it is also possible to employ a clip like that illustrated in FIG. 12, which is of a construction believed to be known in the art. Clip 179 includes a base portion 181, a web 183 and pointed tabs 185 and 187. Base section 181 is made up of a plate 189 and a bent web 191 which extends at about a right angle to plate 189 but then, near the bottom 193 thereof, is further bent outwardly. Spring tab 195 extends from said lower portion of web 191 and is bent near an end 197 thereof so as to form a catch to hold a complementary clip, such as the clip illustrated in FIG. 10. It is seen that spring tab 195 may be pressed against end 150 of clip 143, with the initial contact being at a portion of tab 195 nearer to web bottom 193, and edge 150 will press tab 195 forward (toward the viewer of the drawing) until edge 150 passes the bend line at the rear of the tab, after which the tab will return to original position or near original position and will hold fastener 143 in place, so that wallboards appended to such fastener clips will be aligned. Of course, removal of a wallboard can be effected by reverse relative movements of the boards and the appended clips.

In another version of the invention, shown in FIGS. 13 and 14, fastener clip 199 is comprised of a base portion 201, a web 203 and pointed tabs 205 and 207. Base 201 includes a plate 209 and longitudinally extending exterior rails 211 and 213, joined to the plate by intermediate strengthening walls 215 and 217, respectively. It will be noted that plate 209, wall 215 and rail 211 form a channel, with rail 211 "overlying" plate 209, whereas rail 213 extends outwardly from and parallel to plate 209. Such structure is adapted to readily fitting with a complementary clip of corresponding structure, such as clip 221 of FIG. 14. Keyhole opening 219 in plate 209 is provided for holding means, not shown, for holding the fastener to a substructure member.

Fastener clip 221 comprises a base 223, a web 225 and pointed tabs 227 and 229. Base 223 includes rails 231 and 233 connected to plate 235 by reinforcing and spacing walls 237 and 239. As shown by the dashed lines, representing relative movements of fasteners 199 and 221 for complementing assembly thereof, rail 231 fits into channel 216 and rail 213 fits into channel 234, thereby holding the clips together and maintaining appended wallboard panels in alignment.

FIG. 15 illustrates a fastener clip suitable for use in assemblies like those illustrated in FIG. 3 (not as readily disassemblable as the fasteners of FIGS. 6–14 and 16). Fastener 241 of FIG. 15 includes a base 243, a web 245 and a tab 247, intended for insertion in a slit in a wallboard panel side to which the fastener is to be appended. Base 243 is comprised of a plate portion 249 and a U-shaped peripherally located rail 251 which is held to plate 249 by a corresponding spacing and strengthening wall 250. Fastener 241 is affixable to a substructure member by passage of holding means (not shown) through opening 255 of mounting tab 253, which mounting tab is contiguous with and is an extension of the material of web 245, having been removed from plate 249. For the purpose of this description tab 253 will be considered a part of the base 243 although it also could have been identified as an extension of tab 245.

Complementary clip 257, shown in FIG. 16, is like clip 127 of FIG. 7 except for the omission of an opening for passage of holding means and for the different latching mechanism. In clip 257 web 261 is bent at about a right angle to plate 259 and impaling points 263 and 265 are similarly bent from the web. Web 261 is distorted or impressed so as to produce a cavity represented by numeral 267 with the upper portion thereof extending in the direction in which the pointed tabs point but with the lower part providing a ledge 269, which functions like latch 141 of clip 127 when clip 257 is employed with a catch fastener clip like that of FIG. 6. It will be noted that the upper portion of cavity 267, being inset, provides a clearance for a protrusion like that designated 119 in FIG. 6.

Although preferred embodiments of the invention have been illustrated in the drawing and such embodiments have been described in the preceding portion of this specification, it must be clearly understood that variations of the invention may also be employed and parts of the various fasteners may be interchanged and substituted to create hybrid fasteners which will be capable of operating in essentially the same manners as those illustrated or with various combinations of their properties. The fasteners are primarily intended for employment is assembling pre-finished wallboards, especially those which measure four feet by eight feet and which are normally of thicknesses in the range of $\frac{3}{8}$ inch to 1 inch, e.g., $\frac{1}{2}$ inch to $\frac{3}{4}$ inch, but they may be used for other types of wallboards and panels and for wallboards of other sizes. Also, they may be useful for mounting wood paneling sheets and other paneling materials, and the dimensions of the fastener clips and the dimensions and shapes of the impaling parts may desirably be changed when the clips are adapted for the installation of wood, polymeric plastic foam core, paperboard, fiberboard, honeycombed and other types of such paneling. The invented fasteners may be utilized in the construction of ceilings and of horizontal, vertical and inclined walls and partitions, when it is preferred that such have panels thereof which are readily demountable and remountable.

Although the fasteners are usually of sizes from 2 to 5 cm. in length, and 1 to 3 cm. in width, fasteners of sizes outside such ranges are also considered to be useful and are within the invention. Similarly, sheet metal thicknesses for the fasteners will generally be from 0.5 to 1 or 2 mm. but in some instances they may be as great as 3 or 4 mm. The depths of the strengthening and spacing walls of the fastener clips will usually be at least $\frac{3}{4}$ of the thickness of the sheet or strip material of which the clip is made and the wall thickness and thicknesses of the various clip parts, which are made from the same sheet material, will normally be about the same thickness. While some strengthening and spacing wall lengths may be up to ten times the sheet metal thickness, especially if such walls act as a base of a channel, as in the clip shown in FIG. 5, normally lengths of the walls will be from $\frac{3}{4}$ to 5 times the metal thickness, e.g., 1 to 3 times such thickness, and most often will be sufficient to provide clearance for the head or other projecting part of a screw or other suitable holding means, intended for holding the fastener clip to a substructure member.

Various parts of the fastener clips are normally parallel to each other or at right angles to each other, as illustrated in the drawings, wherein the bases and tabs are normally parallel and the webs are normally at right angles to these. However, in some instances the tabs may be inclined to the web at lesser angles to help them to hold to particular paneled materials. Also, as is shown in the drawing, the reinforcing and spacing walls and the panel contacting and substructure contacting surfaces, especially at the rails, may be angled.

The fasteners of this invention are preferably made of single pieces of sheet material but it is within the invention to utilize a plurality of parts held together to form the individual clips. The material of choice is hardened spring steel, such as SAE 1050 high carbon spring steel (1030–1060 may also be employed), which is annealed before forming and after forming is heat treated (hardened) to a Rockwell hardness in the range of C-24-34, preferably C-28 or C-30. However, it is within this invention to utilize other suitable materials, such as sheet steel, other sheet metals, including aluminum and magnesium-aluminum alloys, synthetic organic polymeric plastics, such as nylons, acrylates, fiberglass reinforced polyesters, and engineering plastics, when suitable. Such materials of construction may be molded or otherwise shaped to form, but preferably, when metal is being utilized, an essentially flat piece of material stamped or cut to desired pattern, punched out, when that is appropriate, and bent, will be employed. The various webs, tabs and impaling points may be stamped out from base portions of the fasteners or may be bent from extensions thereof, and the various slots, openings and channels may be varied in size and shape, including degrees of "oversize". Although it is within the invention to install the various fasteners in the wallboard prior to shipment to the job site, and such installation may be with the aid of adhesives, glues, cements and thermoplastic fastening means, it is primarily intended for the clips to be installed in the wallboards and for the boards to be joined together by means of them at the construction site, and for such installations to be by the craftsmen constructing the wall.

Different manufacturing methods make it possible to further modify and improve the structures of the present clips, and to increase production efficiency. For example, the clips may be partially formed by extrusion or roll forming instead of being cut and bent, and subsequently bends may be made and holes or slots may be punched out, after which they may be hardened.

Various significant advantages attach to the employment of the present fastener clips and to the walls constructed with them and the held wallboards or panels. The fasteners intended for use alternately on abutting wallboards may all be of the same type, with the fasteners on one side of a wallboard only being held to the substructure. Sometimes not all of such fasteners on the held side have to be fastened to the substructure and sometimes some such fasteners may be omitted, with the remaining fasteners, on the abutting wallboards, serving satisfactorily to align the wallboards. Utilizing longitudinally rigidifying rails or tracks, as on the illustrated clips, stiffens the fasteners so that they can satisfactorily resist installation forces, as from a hammer, and allows application of such forces on the fastener end, rather than on the web, thereby making the hammering easier and less likely to result in objectionable marking of the wallboard. Tools for this purpose may also be made and employed, usually in conjunction with a hammer. Additionally, with strengthening members reinforcing the web and holding it in position better, any distortions of the web may be minimized, but even if it were to be bent slightly during installation, such could be rectified by application of a hammer tap or two to the web area, near the tab or impaling points. The clip fasteners of this invention, while preferably including impaling points, may include tab members instead, which are not pointed but which are adapted for fitting kerfs in wallboard sides.

Transverse rigidifying portions of the clip, as shown in FIG. 5, may be employed to prevent any possible twisting of the clip under strain but often such will not be utilized because the structure of such clips, particularly when they are rectangular in shape, with continuous sections of sheet metal connecting the longitudinally external rails, gives the fastener sufficient strength to resist distortion during normal installation and use. Of course, the presences of slots, oversized holes or other openings facilitates positioning of the clip as desired for holding to a substructure by a suitable fastener. The web and tab or impaling point portions of the fastener are from the base portion thereof so no additional metal is needed for such parts, and removal of the metal for such parts from the base does not seriously weaken the fastener. Finally, when the rectangular shape of the fastener is employed there is little or no waste in cutting the blanks from a larger metal sheet.

In the aspect of this invention wherein catch and latch clips which interconnect are employed alternately on different abutting sides of adjoining wallboards, with all of one type on one such side and all of the other on the other such side, and with such alternation continuing down the wall length, it is no longer necessary to begin a dismantling (or installation) operation at a corner of a wall or to have a wallboard noticeably marked or damaged during removal (or visibly fastened during installation). While the fasteners discussed in the preceding few paragraphs are such that the assembled walls may be readily disassembled, normally one starts the disassembly at a corner or other suitable location, usually where the installation of that particular wall was completed. With the present complementary clips, disassembly may be at any location desired and only a single panel has to be removed, although adjoining panels may sometimes also be loosened somewhat. Then, when the panel is to be reinstalled, it may often be snapped in place or guided into position.

It will be seen that the clips intended for complementary fastening together in latch and catch or equivalent relationship possess many of the structural and manufacturing advantages mentioned for the other fasteners previously discussed. Additionally, they are unique and advantageous in other respects. For example, by locating of the catch and latch features as parts of, on, at or near the web portions thereof, the latch and catch parts are stabilized and any accidental release thereof due to bending forces, as might possibly occur if they were at clip ends, is prevented. Similarly, the presences of the indentations and protrusions of the clip catch structures can help to rigidify the webs, and the interconnections between latch and catch portions of the fastener clips can similarly strengthen the webs, especially because both webs are held together and in place between the abutting wallboard sides. Such abutting wallboard sides, being slightly tapered, with the contacting portions thereof at the front faces, provide room for the latch and catch clip portions to be inserted between them, because such portions are toward the backs of the wallboard sides, where the greater openings are present. Thus, the projections from the web of the latch and catch parts do not hold the wallboards apart and good contacts between them at their front major surfaces (or near such surfaces) are obtained. Also, the tapering of the wallboard sides mentioned allows uses of various catch clips of the type described, despite projections of web portions thereof, as alternating clips, should such use be desired, when it is not necessary for particular panels to be independently readily dismantlable. In other words, instead of pairs of fastener clips and complementary clips being removably fitted together to hold the wallboards or panels in alignment and to a substructure, the fastener or catch clips (like those of FIG. 6) may be employed in the manner described for the clips shown in FIGS. 1–5. Similarly, of course, other types of catch clips of this invention, such as those shown in FIGS. 10 and 13, may be used in such manner.

Although the clip illustrated in FIG. 12 is believed to be known to the art and is not per se a part of the present invention, apart from its combination with a holding clip of this invention and installed in a wall thereof, the other complementary clips illustrated and variations thereof are novel and are advantageous over the clip of FIG. 12 in several respects. First of all, clips like those of FIG. 7 may more positively hold the wallboards in position and such holding is with respect to other wallboard clips, not firring members or stud portions. Because the latch means is close to (actually on) the web portion of such clips, it is less subject to bending and effects a more positive hold with respect to a catch clip. Additionally, because of the flat bottoms of the clips of this invention or the even rails thereon such clips may be substituted for corner clips, used to assist the installation of wallboards at room corners, which clips are fastened to a substructure member with the impaling points or tabs thereof inserted into the side of the wallboard to be installed, thus holding it in place.

To assemble walls of this invention utilizing clips in the alternating arrangement illustrated in FIG. 3 (although the clips may be any of many different types) has already been described in my U.S. Pat. Nos. 4,117,644, 4,221,095 and 4,296,580, which patents are incorporated herein by reference (the last named patent is scheduled to issue on Oct. 27, 1981 from application Ser. No. 171,331, filed July 23, 1980). Accordingly, such methods of assembly and disassembly need not be discussed further here. However, the methods employed with respect to the walls assembled with clips which make individual panels thereof readily removable will be described.

To assemble a readily dismantlable wall of this invention one may begin in a corner or other suitable location. For the purpose of this discussion it will be assumed that the beginning is at a right corner. At such location the first wallboard may be nailed or screwed at its right side, where such fasteners may be concealed by a wallboard on the adjacent wall (which is butted against the major surface of the first wallboard at the right side thereof at a right angle). Alternatively, a latch clip, such as that illustrated in FIGS. 7, 11, 14 or 16, may be utilized as a corner clip (or a standard corner clip may be employed) and concealedly fastened to a stud at such corner, with the wallboard side being impaled on it after such fastening. If desired, for such complementary clips which are flat bottomed (or for flat bottomed corner clips), without what might be considered spacing features, shims may be employed, so that the tabs (such as that shown in FIG. 15 on a different type of clip) or impaling points may fit any kerf in the wallboard or may penetrate the board near the middle of its thickness. After insertion or impaling of a series of holding clips along the left side of the wallboard such are screwed or otherwise held to the appropriate stud and then additional wallboards, to which the complementary and holding clips have previously been applied, are installed. For such installations the wallboard to be installed is aligned with that already in place and is slid to the right so that the complementary clips of the sliding board are locked in place by the catch clips of the installed board. Then the holding clips on the left side of the board being installed are fastened to the stud, framing member or other substructure. The procedure is continued to the end of the wall. At this point, the last wallboard is measured, cut to size, if necessary, and installed, either by being fastened in place, with the fasteners to be hidden by the wallboard of the adjoining wall at the corner or by being impaled on corner clips, such as those previously described, and snap fitted into place with the complementary clips thereof snapping into place against the catch clips of the last installed board. Snap fitting into place of the clips may be effected at various locations during assembly of the wall and sometimes it can help to create even tighter joints, as when the holding clips are fastened in place slightly "short" and then the wallboard, with attached latch clip thereon, is pressed into alignment with the previously installed wallboard. Of course, snapping of a wallboard into its place may also be effected when the complementary clips employed are like those shown in FIG. 16 or when like those in FIGS. 11 and 12, when the holding clip is like that of FIG. 10 or a variation thereof. When clip designs are like those of FIGS. 13 and 14, instead of sliding the second wallboard into place against the first one it will be lowered into position or raised into position with respect thereto.

After the wall is installed ceiling and floor trim strips will also normally be installed and advantage is taken in the present invention of such strips to conceal openings at the wallboard tops or bottoms, or both tops and bottoms, to facilitate ready movement of the wallboards for dismantling (and, in some cases, for assembly). In instances when such vertical movement of the wallboard is not needed the presence of such a clearance may be desirable so that one can obtain access to the back of a wallboard and pull it forward to release it and the complementary clip fasteners of the snap fitting type from the fastening clips that are held to the substructure.

Such types of complementary clips are illustrated in FIGS. 11, 12 and 16. While such clips will help to hold the wallboard in alignment and against the substructure by being held to the holding clips which are fastened to the substructure, they may not have as positive a holding effect as complementary clips like those of FIGS. 7 and 14. Note that the clip of FIG. 7 will snap into place but with the design of the catch clip being like that of FIG. 6 it will not readily snap out of place when sufficient force is applied, without bending or breaking the clip, whereas when the clip of FIG. 16 is utilized with that of FIG. 6 it may snap into and out of place with respect to such holding clip but will not hold the wallboards as positively in alignment.

A method useful for removing the wallboards when snap clip affixation is effected has already been described. A suitable method for removing individual wallboards when more positive holding mechanisms are employed will now be mentioned. To remove a particular wallboard the side of the adjoining wallboard with the complementary clip (that of FIG. 7 if the combination of the clips of FIGS. 6 and 7 is employed thereon) will be raised or lowered, after removal of the top and/or bottom trim strip and any fasteners that may have been employed to hold the wallboard to the top or bottom sill or joist. (The wallboard may be supported by shims on the floor or subfloor if sagging is a problem). That side of the wallboard (the right side as per this discussion) will be moved vertically sufficiently far, usually about 2 mm. to 1 cm., e.g., 4 to 6 mm., to disengage the latch-catch lock, after which the wallboard will be moved forwardly or inwardly, into the room and toward the remover, so as to expose the holders on the catch clips of the panel to be removed. Such holders will then be removed or otherwise disengaged and the wallboard to be removed will be moved vertically (upwardly or downwardly, whichever is appropriate), to disengage the right latch members thereof from the catches of the next wallboard, and will then be moved into the room and toward the remover, away from the substructure, to remove it from the rest of the wall. Of course, such order of operations can be modified to first release the latch clips to the panel to be removed, followed by removals of the latch clips of the adjoining panel and the holders on the board to be separated from the wall. To reinstall it involves only a reversal of such steps. When clips of the types shown in FIGS. 13 and 14 are employed, a similar procedure may be followed. When the wallboard is sufficiently rigid so that vertical movement of a side thereof is not feasible while the other side is being rigidly held in place, the fastener clips will normally include a slot, like that shown in FIG. 13, to permit vertical movement of the board. In such case, the holding means will not be tightened so must as to prevent the appropriate vertical movement and supplementary holding means will be employed, usually hidden by the ceiling trim or floor trim strip(s), to hold the wall firmly in place, or, if desired, clearance could be allowed at the top of the wallboard, with the base resting on a sill or floor member.

In another aspect of the invention, it may be possible for the clips to be disengaged by bowing the wallboard to release the latch from the catch members, without the need for vertical movements of the board sides to effect such disengagements. In some assemblies, as when the wallboards include only one type of clip impaled on the sides thereof, with the adjoining wallboards having clips of the other type, a wallboard may be removed by such bowing action, or by lifting and moving into the room. This is especially useful when it is known in advance which wallboard will most likely have to be removed in the future, due to a need to obtain access to utilities lines, telephone junction boxes, etc. The bowing can be effected by means of a conventional pry bar, a tool normally present on job sites. Removal of a wallboard by utilizing such bowing movement thereof is more readily effected with a complementary latch clip of the type shown in FIG. 16 because of the rounded edge thereof that contacts the tongue of the catch member. The ease of removal of the clip of the type shown in FIG. 7 by means of bowing can be increased by rounding the edge of tongue 141 thereof, too. However, even without roundings of such parts, complementary latch clips can be disengaged from the catch clips by such bowing actions.

As is seen from the previous description, the described aspect of the present invention provides a simple means for readily facilitating independent removals of wallboard panels, as may be desired, without damaging the panel and without requiring removals of additional wallboards, except for the easily effected partial removal of one portion of an adjacent wallboard. Yet, the various fastener and complementary clips described are also adaptable to other wallboard installation uses, as previously described.

The invention has been described in detail with respect to various preferred embodiments thereof but it is evident that its scope is not to be so limited because one of skill in the art, with the present specification before him, will be able to utilize substitutes and equivalents for elements of the invention without departing from it. Similarly, while variations of the invention have been mentioned, such a listing is not exhaustive and neither are the recitations of advantages of the invention which have been given.

What is claimed is:

1. A readily dismantlable wall or partition comprising a substructure and a surface structure, said substructure including framing or supporting means for holding the surface structure to and spaced away from the substructure, and said surface structure comprising first and second aligned substantially flat panels, adjacent at sides thereof, each of which has concealed major back, sides, top and bottom surfaces and a visible major front surface, the sides of which panels are substantially smooth, which panels are substantially invisibly secured to the substructure and spaced away from it and thereby are readily dismantlably secured together at the sides thereof or spaced apart a spacing distance by a first series of spaced apart concealed fastener clips appended to said first panel and to the substructure and a second series of spaced apart concealed fastener clips appended to said second panel and so located as to contact and hold to corresponding fastener clips of the first series, with the fasteners of the first series of clips being made from sheet or strip material and comprising a substantially coplanar and directly continuous spacing base portion which includes, spaced apart, a substructure contacting surface and a panel contacting surface, spaced apart by intermediate strengthening walls, which spacing base portion spaces the major back panel surface from said substructure when such fastener is installed, a web portion extending at about a right angle from said base portion, tab means extending from the web portion and suitable for entering the side of the panel to which the clip is to be appended, with the panel contacting surface of the base portion contacting the major back surface of a panel and with the web contacting a side thereof, and means for readily removably engaging with a complementary fastener clip which is attachable to another wallboard panel at a side thereof to hold the panels together in alignment and to allow easily effected dismantling of the wall by easy separation of the fasteners, when desired, while the fasteners remain fastened to the respective wallboard panels, and, held to the second wallboard panel, in locations thereon such that they fit the fasteners of the first series when the panels are assembled to form a wall or a portion of a wall, a second series of complementary clip fasteners comprising a substantially coplanar and directly continuous base portion, a web portion extending at about at right angle from said base portion, tab means extending from the web portion and suitable for entering the side of a panel to which the clip is to be appended, and means for readily removably fitting with the engaging means on the matching clips held to the first panel and for readily removably engaging with them to hold the wallboard panels together and in alignment and to allow easily effected dismantling of the wall by easy separation of the fasteners, when desired, while they remain fastened to the respective wallboard panels.

2. A readily dismantlable wall or partition according to claim 1 wherein the fastener clips held to the first panel are snap fittable to the complementary fastener clips held to the second panel.

3. A wall according to claim 2 wherein the fastener clips include curved rails which are so curved that they contact the back major surface of the wallboard panel, and the complementary fastener clips include curved rails, curved in the opposite direction from the rails of the fastener clips, when such clips are in snap fastened position, with the rails of both clips being parts of the snap fastening means.

4. A wall according to claim 1 wherein the engaging means of the clips held to the first panel is a part of the base portion of said clip and the fitting means on the complementary matching chips is a bent tongue adapted to readily removably engage the end of the base portion of a corresponding clip to hold the second panel in alignment with the first panel and to permit ready dismantling of the panels by movement in a direction away from the substructure of a side of the second panel which contacts a corresponding side of the first panel.

5. A wall accordng to claim 1 wherein the spacing base portions of the series of clips appended to the side of the first panel each include longitudinal rails and a plate portion, with one rail of each clip being directed inwardly, toward the major part of the fastener, and with another rail being directed outwardly, and with the complementary fastener clip including fitting longitudinal rail portions, with an outwardly directed portion fittable in a channel made by the plate and inwardly directed rail portion of the matching fastener and a channel shaped rail of the complementary clip fastener fitting the outwardly projecting rail of the matching fastener.

6. A method of removing wallboard or panels installed on a substructure to form an easily dismantlable wall or partition comprising a substructure and a surface structure, said substructure including framing or supporting means for holding the surface structure to and spaced away from the substructure, and said surface structure comprising first and second aligned substantially flat panels, adjacent at sides thereof, each of which has concealed major back, sides, top and bottom surfaces and a visible major front surface, the sides of which panels are substantially smooth, which panels are substantially invisibly secured to the substructure and spaced away from it and thereby are readily dismantlably secured together at the sides thereof by a first series of spaced apart concealed fastener clips appended to said first panel and held by holding means to the substructure and a second series of spaced apart concealed fastener clips appended to said second panel and so located as to contact and hold to corresponding fastener clips of the first series and cover portions of said clips and the means for holding them to the substructure or have the second panel cover such portions and such means, with the fasteners of the first series of clips being made from sheet or strip material and comprising a substantially coplanar and directly continuous spacing base portion which includes a substructure contacting surface and a panel contacting surface, spaced apart by intermediate strengthening walls, which spacing base portion spaces the major back panel surface from said substructure when such fastener is installed, a web portion extending at about a right angle from said base portion, tab means extending from the web portion and suitable for entering the side of the panel to which the clip is to be appended, with the panel contacting surface of the base portion contacting the major back surface of a panel and with the web contacting a side thereof, and means for readily removably engaging with a complementary fastener clip which is attachable to another wallboard panel at a side thereof to hold the panels together in alignment and to allow easily effected dismantling of the wall by easy separation of the fasteners, when desired, while the fasteners remain fastened to the respective wallboard panels, and, held to the second wallboard panel, in locations thereon such that they fit the fasteners of the first series when the panels are assembled to form a wall or a portion of a wall, a second series of complementary clip fasteners comprising a substantially coplanar and directly continuous base portion, a web portion extending at about at right angle from said base portion, tab means extending from the web portion and suitable for entering the side of a panel to which the clip is to be appended, and means for readily removably fitting with the engaging means on the matching clips held to the first panel and for readily removably engaging with them to hold the wallboard panels together and in alignment and to allow easily effected dismantling of the wall by easy separation of the fasteners, when desired, while they remain fastened to the respective wallboard panels, with the fastener clips being alternately appended to the sides of the first and second panels so that all of one type of clip are located on one side and all of the complementary type are located on an abutting side, with such arrangement being continued for additional panels adjacent the first and second panels, which comprises disengaging the second set of complementary clips from the first set of fastener clips, to which they are held, by moving such second set of clips to effect such disengagement, whereby the holding means for holding the first set of clip fasteners and the first panel to the substructure becomes accessible, removing such holding means, removing the set of complementary fasteners of the first panel from the fasteners to which they are held, and removing the first panel from the wall.

7. A method of removing wallboard or panels installed on a substructure to form an easily dismantlable wall or partition comprising a substructure and a surface structure, said substructure including framing or supporting means for holding the surface structure to and spaced away from the substructure, and said surface structure comprising first and second aligned substantially flat panels, adjacent at sides thereof, each of which has concealed major back, sides, top and bottom surfaces and a visible major front surface, the sides of which panels are substantially smooth, which panels are substantially invisibly secured to the substructure and spaced away from it and thereby are readily dismantlably secured together at the sides thereof by a first series of spaced apart concealed fastener clips appended to said first panel and held by holding means to the substructure and a second series of spaced apart concealed fastener clips appended to said second panel and so located as to contact and hold to corresponding fastener clips of the first series and cover portions of said clips and the means for holding them to the substructure or have the second panel cover such portions and such means, with the fasteners of the first series of clips being made from sheet or strip material and comprising a substantially coplanar and directly continuous spacing base portion which includes a substructure contacting surface and a panel contacting surface, spaced apart by intermediate strengthening walls, which spacing base portion spaces the major back panel surface from said substructure when such fastener is installed, a web portion extending at about a right angle from said base portion, tab means extending from the web portion and suitable for entering the side of the panel to which the clip is to be appended, with the panel contacting surface of the base portion contacting the major back surface of a panel and with the web contacting a side thereof, and means for readily removably engaging with a complementary fastener clip which is attachable to another wallboard panel at a side thereof to hold the panels together in alignment and to allow easily effected dismantling of the wall by easy separation of the fasteners, when desired, while the fasteners remain fastened to the respective wallboard panels, and, held to the second wallboard panel, in locations thereon such that they fit the fasteners of the first series when the panels are assembled to form a wall or a portion of a wall, a second series of complementary clip fasteners comprising a substantially coplanar and directly continuous base portion, a web portion extending at about at right angle from said base portion, tab means extending from the web portion and suitable for entering the side of a panel to which the clip is to be appended, and means for readily removably fitting with the engaging means on the matching clips held to the first panel and for readily removably engaging with them to hold the wallboard panels together and in alignment and to allow easily effected dismantling of the wall by easy separation of the fasteners, when desired, while they remain fastened to the respective wallboard panels, with the fastener clips being alternately appended to the sides of the first and second panels so that all of one type of clip are located on one side and all of the complementary type are located on an abutting side, with such arrangement being continued for additional panels adjacent the first and second panels, which comprises disengaging the set of complementary clips on the first wallboard panel from the fastener clips to which they are held, by moving such complementary clips to effect such disengagement, disengaging the second set of complementary clips, of the second wallboard panel, from the first set of fastener clips, on the first panel, to which they are held, by moving such second set of complementary clips to effect such disengagement, whereby the holding means for holding the first set of clip fasteners and the first panel becomes accessible, removing such holding means, and removing the first panel from the wall.

8. A method according to claim 6 wherein the fastener clips are made from sheet or strip material and comprise a substantially coplanar and directly continuous spacing base portion which includes, spaced apart, a substructure contacting surface and a panel contacting surface, spaced apart by intermediate strengthening wall(s), which spacing base portion spaces a major back panel surface from said substructure when such fastener is installed, a web portion extending at about a right angle from said base portion, tab means extending from the web portion and suitable for entering the side of a panel to which the fastener is appended, with the panel contacting surface of the base portion contacting the major back surface of the panel and with the web contacting a side thereof, and means for positively engaging with a complementary fastener clip of different structure and for readily removably disengaging from said complementary fastener clip when desired, which means is a catch means projecting from the web of the fastener and capable of readily dismantlably holding a latch means of the complementary fastener clip in positive engagement, which catch means are separable from said complementary clips, when the panels are installed to form a vertical wall, by relative vertical movement of the wallboard fasteners resulting from relative vertical movement of the wallboard panels on which they are installed, followed by movement in the direction of the room interior and away from the substructure of one of the wallboard panels at a side thereof not fastened to the substructure, so that, when desired, easy dismantling of the wall by easy separation of the fasteners is effectable, while the fasteners remain fastened to the respective wallboard panels.

9. A method according to claim 8 which comprises moving a side of a second panel, to which the complementary fastener clips are held, vertically far enough to allow disengagement of such fastener clips and panel sides from the fastener clips held to the first panel and the substructure, moving said second panel side inwardly toward the room, thereby disengaging it from the first panel, releasing the holding means holding the first series of fastener clips of the first panel to the substructure, and moving the other end of the first panel vertically and into the room, toward the remover, to remove the first panel from the wall.

10. A method according to claim 8 which comprises moving an end of the first panel, onto which the complementary fastener clips are appended, vertically far enough to allow disengagement of such fastener clips and panel side from the fastener clips held to an adjoining panel and the substructure and into the room, toward the remover, moving an abutting side of the second panel, to which complementary fastener clips are held, vertically far enough to allow disengagement of such fastener clips and the second panel side from the fastener clips held to the first panel and the substructure, and into the room and toward the remover, thereby disengaging it from the first panel, releasing the holding means holding the first series of fastener clips of the first panel to the substructure, and moving the first panel into the room to remove it from the wall.

11. Mounting means, useful for installing wallboard or similar panels on a substructure to form an easily dismantlable wall or partition wherein such mounting means are substantially concealed, comprising a fastener made from sheet or strip material and having a substantially coplanar and directly continuous spacing base portion which includes, spaced apart, a substructure contacting surface and a panel contacting surface, spaced apart by intermediate strengthening wall(s), which spacing base portion spaces a major back panel surface from said substructure when such fastener is installed, a web portion extending at about a right angle from said base portion, tab means extending from the web portion and suitable for entering the side of a panel to which the fastener is appended, with the panel contacting surface of the base portion contacting the major back surface of a panel and with the web contacting a side thereof, and a complementary fastener clip of different structure from the fastener, which clip is attachable to another wallboard panel at a side thereof, the fastener including means for positively engaging with the complementary fastener clip of different structure and for readily removably disengaging from said complementary fastener clip when desired, to hold the wallboard panels together and in alignment at sides thereof and to allow positive locking together of the wallboard panels and easily effectable dismantling of the wall by easy separation of the fasteners, when desired, while the fasteners remain fastened to the respective wallboard panels.

12. Mounting means according to claim 11 wherein the means for readily removably engaging with the complementary clip are separable from said complementary clip, when the panels are installed to form a vertical wall, by relative vertical movement of the wallboard fasteners resulting from relative vertical movement of the wallboard panels on which they are installed, followed by movement in the direction of the room interior and away from the substructure of one of the wallboard panels at a side thereof not fastened to the substructure.

13. A fastener according to claim 12 wherein the means for readily removably engaging with the complementary clip is a catch means projecting from the web of the fastener and capable of readily dismantlably holding a latch means of the complementary clip.

14. A fastener according to claim 13 wherein the web is at about a right angle to the base portion, reinforcing reverse indentations are present where the web and base meet, and strengthen the web, the tab means includes two pointed tabs on opposite sides of the longitudinal axis of the fastener, for impaling the side of a wallboard to which a fastener is to be held, and the catch means is a pressed-out section of the web, separated from the web at a portion thereof nearer to the base and extending in a direction opposite to that of the pointed tabs.

15. A fastener according to claim 14 which is of substantially rectangular shape and in which the spacing base comprises longitudinal rails and plate portion, with intermediate strengthening walls connecting such rails and plate portion, with the face of the plate, when the fastener is installed, contacting a major back surface of a panel or the substructure, and with the rails contacting the other of such substructure and major back surface of a panel, and with the plate including an oversized opening through which holding means for holding the fastener against the substructure may be passed to adjustably hold the fastener to such substructure.

16. Mounting means according to claim 11 in which the spacing base portion of the fastener comprises longitudinal rails and a plate portion, spaced apart by the intermediate strengthening walls, which connect such rails and plate portion, with a face of the plate, when the fastener is installed, contacting a major back surface of a panel or the substructure, and with the rails contacting the other of such substructure and major back surface of a panel.

17. Mounting means comprising a complementary fastener clip which includes a plate, a web at the end of the plate extending at about a right angle therefrom, tab means at the end of the web extending at about a right angle therefrom in the direction in which the plate extends, and latch means, of a sheet or strip material from which the fastener is made and from a part thereof which would otherwise have been part of the web, which latch means extends as a continuation of the plate beyond the web, and a fastener clip of different structure, incorporating a catch means with which the latch means of the complementary fastener clip is adapted to engage in positively locking engagement, so that when such different complementary fastener and fastener clips are joined to sides of adjacent wallboard panels and at least one such clip is held to a substructure, the wallboard panels, assembled in a wall, are positively held to such substructure and are readily removable therefrom by readily effectable disengagement of the latch means from the catch means of the clips.

18. Mounting means comprising a complementary fastener clip which includes a plate, a web at the end of the plate extending at about a right angle therefrom, tab means at the end of the web extending at about a right angle therefrom in the direction in which the plate extends, and latch means which are a part of the web, and a fastener clip of different structure, including catch means, the latch means including an indentation therein complementing the shape of the catch means of the fastener of different structure, in which catch means the latch means is to be held, and including a ledge portion to be held by such catch means, so that when such different fastener clips are joined to sides of adjacent wallboard panels, and at least one such fastener clip is held to a substructure, the wallboard panels, assembled in a wall, will be positively held to such substructure and will be readily removable therefrom by readily effectable disengagement of the latch means of such complementary fastening clip from the catch means of the other fastener clip.

* * * * *